United States Patent [19]

Shneider

[11] 4,021,947

[45] May 10, 1977

[54] ROTARY DISPLAY STANDS

[76] Inventor: Aaron H. Shneider, 2835 N. Western Ave., Chicago, Ill. 60618

[22] Filed: Oct. 30, 1975

[21] Appl. No.: 627,100

[52] U.S. Cl. ..... 40/68.6
[51] Int. Cl.[2] ..... G09F 11/02
[58] Field of Search ..... 40/72, 68, 68.6

[56] References Cited

UNITED STATES PATENTS

| | | | |
|---|---|---|---|
| 1,558,376 | 10/1925 | Lewis et al. | 40/68.6 |
| 1,845,700 | 2/1932 | Carlson et al. | 40/68.6 |
| 2,368,162 | 1/1945 | Schogield | 40/68.6 |
| 2,651,305 | 9/1953 | Discount | 40/68.6 |

*Primary Examiner*—Hugh R. Chamblee
*Assistant Examiner*—Wenceslao J. Contreras

[57] ABSTRACT

A display stand for a radial group of data units rotatable by a central spindle journaled in the base of the stand. The inner portions of the units occur between facing cup-shaped guides carried by the spindle; and the units and walls of the cups have interlocking formations allowing units to be coupled with or disengaged from the guides. However, the units are retained for rotary and selective handling when coupled with the guides.

2 Claims, 3 Drawing Figures

ROTARY DISPLAY STANDS

This invention relates to stands which carry a circular group of transparent pockets for displaying record or picture cards; and such stands have a rotatable spindle to turn the card pockets for convenient selection or viewing. The spindle in one form of stand is positioned horizontally, and has a knob at each end for turning it. Usually, the spindle carries metal rings for retaining and guiding the pockets as they are rotated by the viewer; and the rings must be welded to the spindle in order to be rigidly positioned. Thus, a technique is involved for assembling the spindle which requires delicate manual operations and handling, so that the production of the stands is costly. It is therefore one object of this invention to provide such stands with pocket-supporting and guiding units which are non-metallic and in the form of inexpensive stock or stamped materials.

A further object is to construct the card pockets with head portions which have slots on the sides for convenient coupling with the pocket-supporting and guiding units in a manner to support the pockets both retentively and for convenient mounting into or removal from the stand.

Another object is to design a spindle for the above purpose which is made from stock material and produced by machine methods.

A better understanding of the invention may be gained by reference to the accompanying drawing, in which FIG. 1 is a side view of the improved display stand;

Figure 2:
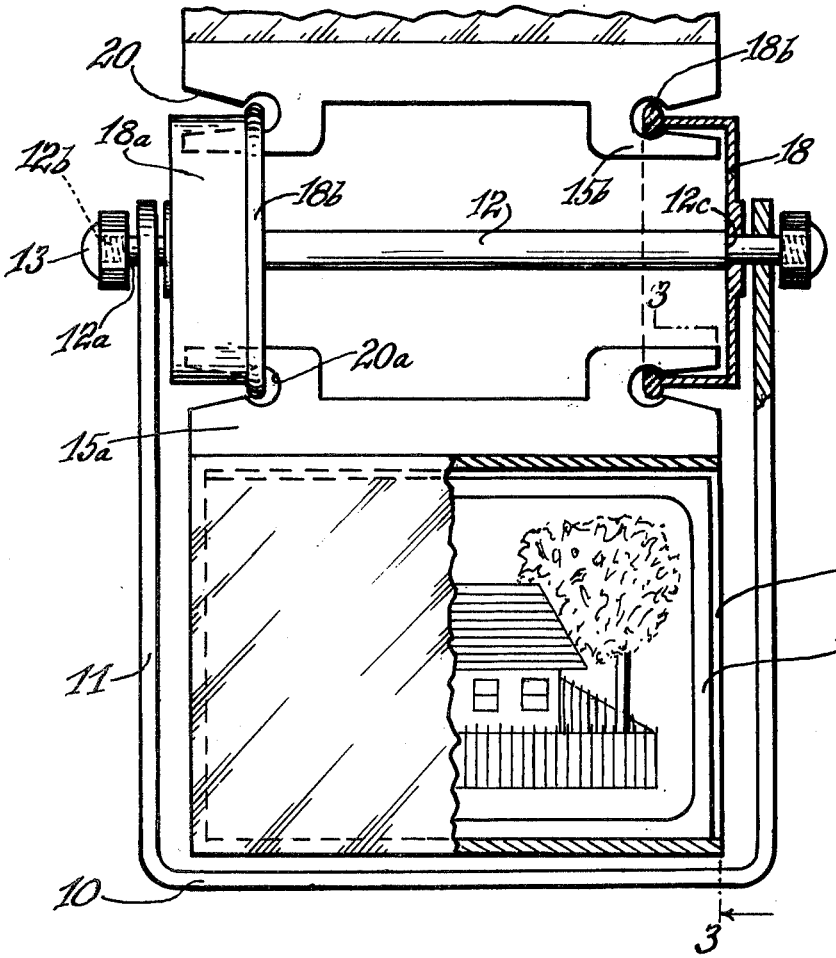
FIG. 2 is an enlarged end view, partly broken away.

Referring specifically to the drawing, FIG. 2 shows that the base of the stand is of U-form, having a bottom 10 and upward terminal walls 11; and the material of the base is solid plastic normally rigid, but having a factor of flexibility.

Figure 3:
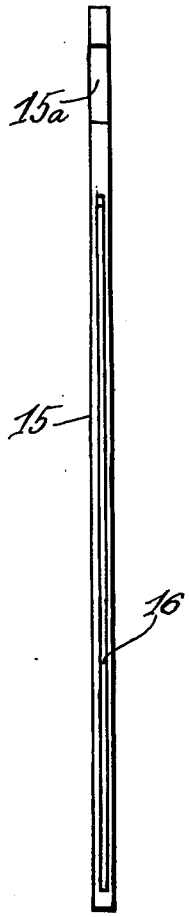
FIG. 3 is a magnified edge view of a card pocket taken from the line 3—3 of FIG. 2.

The walls 11 serve as journals for the end-tips 12*a* of a horizontal spindle 12; and such end-tips are threaded as indicated at 12*b* to receive finger knobs 13. The end-tips 12 are designed to receive the guides for supporting the card pockets, and move them forth and back when a finger knob is turned. As clearly shown in FIGS. 2 and 3, each card pocket 15 has a solid head portion 15*a*, and opens at one side to receive a card 16 showing a picture or other subject.

A pair of card pocket guides is shown in FIG. 2, each cup-shaped with a bottom 18, a side wall 18*a* and a rim with an external bead 18*b* and an internal one 18*c*. The figure shows the cups in facing relation; and each is mounted on the spindle — before the knobs are screwed on — by pressing it firmly on the related end-tip 12*a* until the cup meets a shoulder 12*c* of the spindle as a stop. The stand is now ready to receive a group of card pockets 15.

The head portion 15 of each card pocket has flared side slots 20 terminating with part-circular openings 20*a*. These are constricted on the outer side to meet angular stops 15*c* at the constricted inner ends of the slots. To receive a guide 18 as shown, the head portion 15*a* has a factor of flexibility enabling one side of the pocket to be engaged first, and then the other side, locating the guide walls 18*a* in the slots 20 and the beads 18*b* retentively in the openings 20*a*. It is noted in this connection that the stops 15*c* will check tendencies for the pockets to pull free of the guides, while allowing the pockets to turn toward one side or the other when they are being mounted into or removed from the guides. For facility to mount or remove a pocket head portion, the latter has the form of a hook 15*b* on each side which is more flexible for the purpose mentioned. As a rule, this is not a task for the user, as a set of card pockets are a permanent part of the stand; and its use by the owner is only to view or change the cards.

Figure 1:
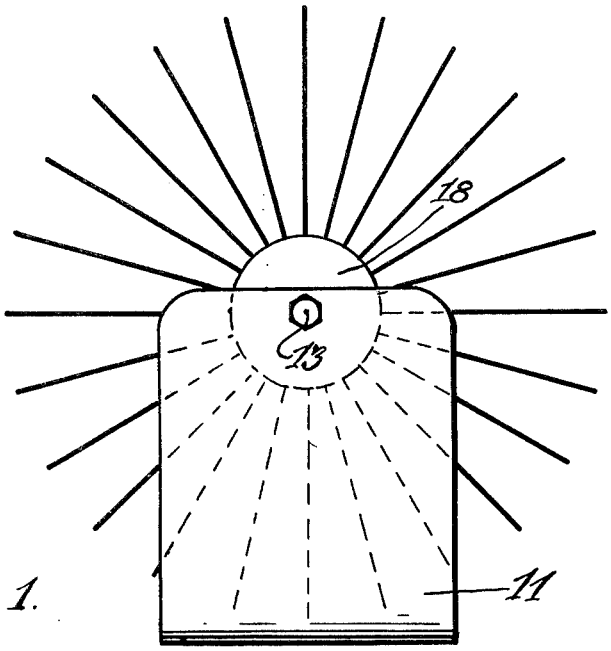

In assembling the display stand, the spindle alone first receives the end guides 18 in rigidly-fitted relation, as previously described. Then one wall 11 of the base receives one of the spindle tips 12*b;* and the other wall is then sprung outwardly to receive the other tip. The knobs 13 are then screwed tightly on the threaded ends of the tips. As to the card pockets, the head portions can be die-cut to be uniform; and they can be mounted in the stand as previously exlained to form the cluster shown in FIG. 1. FIG. 2 shows a lower card pocket receiving the bottoms of the guides, and only the head portion of an upper pocket receiving the tops thereof. The pockets appear slidable individually around the guides, but their combined weight will cause the guides to move them as a group when either knob is turned. Finally, rotary display stands are also made with the spindle in vertical position, and receiving a knob only at the top. The pockets will open upwardly if the stand in FIG. 2 is given a quarter-turn to the left. However, the assembly of pockets and guides in the stand will remain the same, with the pockets moving to one side or the other — instead of up and down — when the knob is turned.

I claim:

1. A display stand for a plurality of radially mounted planar data displaying means comprising a base element having a flat bottom of a length greater than the length of the planar data means and a base width at least sufficient to provide stability with a wall at each end of said bottom perpendicular thereto and an opening in the distal end of each of said walls; a spindle inserted in said openings, said spindle comprising a mid-portion and two end portions, the mid-portion of said spindle being of a greater diameter than the end portions to provide a shoulder at each end of said mid-portion, means on at least one end portion to cooperate with spindle knobs to secure said spindle within said base; means to support said data display elements on said spindle comprising a pair of cup-shaped elements each having an opening in the bottom surface to frictionally receive the end portion of said spindle and an external and internal bead on the rim of each element, each element being inserted on the end portion of said spindle in frictional engagement therewith and with said shoulder, the elements further being in facing relationship with reference to said beads; each of said data display elements comprising an envelope-like element of flexible material having an opening for the insertion and retension of the data, and a portion for slidable assembly on said cup elements, the portion of the envelope-like element to be assembled on said cup elements having a pair of spaced circular openings and a diverging slot parallel to said spindle and leading from each opening to the adjacent outer edge of said envelope-like element, said openings being of a size to receive said beads on each of said cup elements in slidable relationship therewith, said slot at its intersection with its opening being of a width to receive the wall of said cup-like element and to form at least one stop so as to retain said beads within said openings.

2. A display unit according to claim 1, wherein said base element is of a U-shaped configuration lying on one of the upstanding walls as said base.

* * * * *